United States Patent [19]

Franzen et al.

[11] Patent Number: 4,975,577

[45] Date of Patent: Dec. 4, 1990

[54] METHOD AND INSTRUMENT FOR MASS ANALYZING SAMPLES WITH A QUISTOR

[75] Inventors: Jochen Franzen; Reemt-Holger Gabling, both of Bremen; Gerhard Heinen, Grasberg; Gerhard Weiss, Weyhe, all of Fed. Rep. of Germany

[73] Assignee: The United States of America as represented by the Secretary of the Army, Washington, D.C.

[21] Appl. No.: 459,156

[22] Filed: Dec. 29, 1989

[30] Foreign Application Priority Data

Feb. 18, 1989 [DE] Fed. Rep. of Germany ..... 8910285

[51] Int. Cl.[5] ..... H01J 49; H01J 42

[52] U.S. Cl. ..... 250/291; 250/281; 250/282; 250/290

[58] Field of Search ..... 250/291, 290, 292, 293, 250/281, 282

[56] References Cited

U.S. PATENT DOCUMENTS 4,540,884 9/1985 Stafford et al. ..... 250/282

4,736,101 4/1988 Syka et al. ..... 250/292

4,755,670 7/1988 Syka et al. ..... 250/291

4,818,869 4/1989 Weber-Grabau ..... 250/291

4,882,484 11/1989 Franzen et al. ..... 250/291

*Primary Examiner*—Jack I. Berman

*Assistant Examiner*—Kiet T. Nguyen

*Attorney, Agent, or Firm*—Robert P. Gibson; Edward Goldberg; Michael C. Sachs

[57] ABSTRACT

A method for the measurement of mass spectra by three dimensional quadrupole fields (QUISTORs) is presented, in which the ions are mass-to-charge selectively ejected by a selected nonlinear resonance effect in an inharmonic QUISTOR. In order to enhance scan speed and mass resolution, the ejection of a single kind of ions can be confined to a very small time interval, either by the generation of ions within a small volume outside the field center, or by an excitation of the secular amplitudes by an additional RF voltage across the end electrodes, shortly before the ions encounter the sum resonance condition. An instrument for this method is described.

8 Claims, 3 Drawing Sheets

METHOD AND INSTRUMENT FOR MASS ANALYZING SAMPLES WITH A QUISTOR

GOVERNMENTAL INTEREST

The Government has rights in this invention pursuant to Contract No. DAAA-15-87-C-0008 awarded by the U.S. Army.

BACKGROUND AND FIELD OF THE INVENTION

The present invention concerns a method and an instrument for the fast measurement of mass spectra from sample molecules, a so-called "scanning procedure", using a QUISTOR mass spectrometer.

This special type of mass spectrometer can store ions of different mass-to-charge ratios simultaneously in its radio-frequency hyperbolic three-dimensional quadrupole field. It has been called "QUISTOR" ("Quadrupole Ion STORe") or "ion trap" in the literature. See also our U.S. Pat. No. 4,882,484 issued Nov. 21, 1989 concerning certain of these Quistor applications.

The QUISTOR usually consists of a toroidal ring electrode and two end cap electrodes. A high RF voltage with amplitude $V_{stor}$ and frequency $f_{stor}$ is applied between the ring electrode and the two end caps, eventually superimposed by a DC voltage.

The hyperbolic RF field yields, integrated over a full RF cycle, a resulting force on the ions directed towards the center. This central force field forms, integrated over time, an oscillator for the ions. The resulting oscillations are called the "secular" oscillations of the ions within the QUISTOR field. The secular movements are superimposed by the oscillation impregnated by the RF storage field.

Cylindrical coordinates are used to describe the QUISTOR. The direction from the center towards the saddle line of the ring electrode is called the r direction or r plane. The z direction is defined to be normal to the r plane, and located in the axis of the device.

Up to now, the exact mathematical description, in an explicit and finite form, of the movements of ions in a QUISTOR field is only possible for the special case of independent secular movements in the r and z directions. The solution of the corresponding "Mathieu"'s differential equations results in a QUISTOR of fixed design with an angle of $z/r=1/1.414$ (1.414=square root of 2) of the double-cone which is asymptotic to the hyperbolic field. In this case, the central force is exactly proportional to the distance from the center, and exactly directed towards the center. This defines a harmonic oscillator, and the resulting secular movements are exactly harmonic oscillations.

In this special case of an "harmonic QUISTOR", the secular oscillations can be calculated. The frequencies are usually plotted as "beta" lines in a so-called "a/q" diagram, where "a" is proportional to the DC voltage between ring and end electrodes, and "q" is proportional to the RF voltage. The beta lines describe exactly the secular frequencies in the r and z directions:

$$f_{sec,r}=\text{beta}_r*f_{stor}/2;$$

$$f_{sec,z}=\text{beta}_z*f_{stor}/2.$$

LIST OF FIGURES

DESCRIPTION OF THE INVENTION

Figure 1:
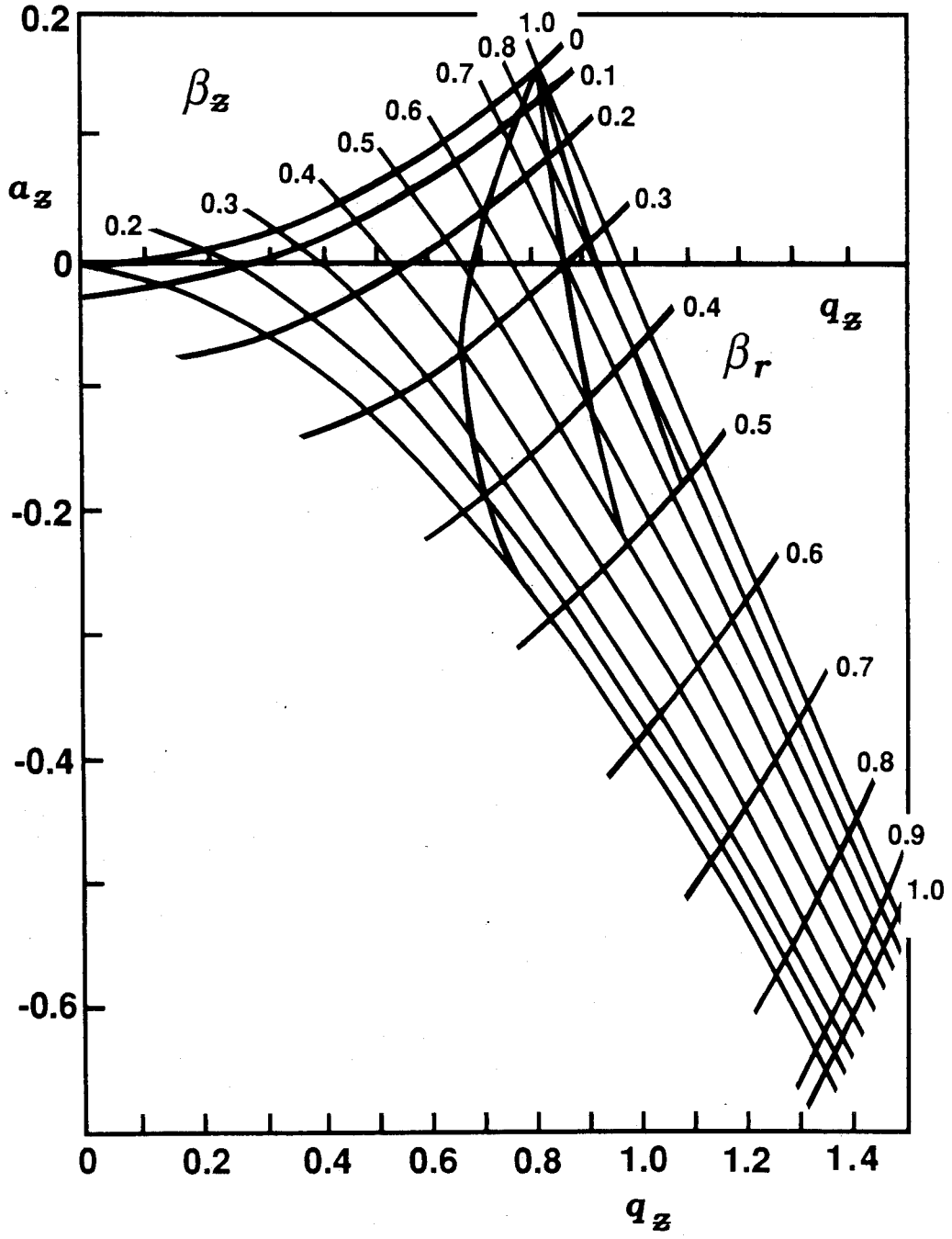
FIG. 1 shows the stability area for an "ideal" QUISTOR in an az/qz diagram, with iso-beta lines. Resonance condition lines for hexapole, octopole, and dodecapole field faults are given, crossing the iso-beta lines.

In FIG. 1, the "a/q" diagrams with iso-beta lines is shown. In the "stability" area defined by $0<\text{beta}_r<1$ and $0<\text{beta}_z>1$, the secular oscillations of the ions are stable. Outside this stability area, the forces on the ions are directed away from the field center, and the oscillations are unstable. Up to now, two basically different modes of scanning procedures for stored ions over a wide range of mass-to-charge ratio by mass-to-charge selective ejection of ions, have become known. First, U.S. Pat. No. 4,540,884 describes a "mass selective instability scan". The quadrupole field is scanned in such a way that ions with subsequent mass-to-charge ratios encounter a destabilization by the conditions at or even outside the stability area border with $\text{beta}_z=1$. These ions become unstable, leave the quadrupole field, and are detected as they leave the field. Second, U.S. Pat. No. 4,736,101 describes a scan method making use of the mass selective resonant ion ejection by an additional RF voltage across the end electrodes which is well-known from the literature. Our invention is directed to another basically different scanning procedure making primary use of the sharp natural resonance conditions in inharmonic QUISTORs.

Most of the QUISTORs which have been built up to now, especially QUISTORs for high mass resolution scans, follow the design principles of "harmonic QUISTORs" with hyperbolic surfaces and the above "ideal" angle $z/r=1.414$, although it has been shown experimentally that QUISTORs of quite different design, e.g. with cylindrical surfaces, can store ions, even if these devices may encounter losses of specific ions.

In regard to "inharmonic QUISTORs" which are not built according to the above ideal design criteria, the secular oscillations in one direction are coupled with the secular oscillations in the other direction. As is known from coupled oscillators, natural resonance phenomena will appear. Depending on the type of field distortions, several types of natural resonance, called "sum resonances", "coupling resonances", exist in a QUISTOR or nonlinear resonances.

These natural resonances were explained theoretically by the effect of superimposed weak multipole fields. These natural resonance phenomena were investigated intensively because they caused losses of ions from the QUISTOR, so workers in the field tried to avoid these resonances.

If the quadrupole field is superimposed by a weak multipole field, with one pole fixed in the z direction, the conditions for sum resonances are:

| Type of field | sum resonance condition | Order of potential terms |
|---|---|---|
| quadrupole field: | none | second order, no mixed terms |
| hexapole field: | $beta_z + beta_r/2 = 1$ | third order, with mixed terms |
| octopole field: | $beta_z + beta_r = 1$ | fourth order, with mixed terms |
| dodecapole field: | $beta_z/2 + beta_r = 1$ | sixth order, with mixed terms |

In the case of a strongly harmonic QUISTOR with its exact quadrupole field, the mathematical expression for the electrical potential contains only quadratic terms in r and z, and no mixed terms. No sum resonance exists.

In the case of superimposed multipoles, however, terms of higher order and mixed terms appear. The mixed terms represent the mutual influence of the secular movements, and the terms of higher order than 2 represent non-harmonic additions which make the secular frequencies dependent on the amplitude of the secular oscillations.

In the literature, the superposition of small multipole fields are often designated as "distortions" or "imperfections". In the case of the inharmonic QUISTOR field, the distortion of the field can be described as a finite or infinite sum of coaxial rotation-symmetric three-dimensional multipole fields.

The sum resonance conditions form distinct curves in the a/q stability diagram. (In FIG. 1, the conditions $beta_r+beta_r/2=1$, $betar+beta_z=1$, and $beta_r/2+beta_z=1$ are plotted into the diagram). If an ion fulfils the sum resonance condition, its secular frequency movement amplitude increases, and the ion leaves the field if the condition for resonance lasts.

Our invention provides a method of scanning ions within a predetermined range of mass-to-charge ratios, characterized by the application of an inharmonic QUISTOR field, and making use of a sum resonance condition for ion ejection from the QUISTOR field. Ions of different mass-to-charge ratios are either generated in an harmonic QUISTOR field, or injected into this field from outside. The field conditions are chosen to store ions having mass-to-charge ratios of interest. The QUISTOR field is then changed in such a way that ions of subsequent mass-to-charge ratios encounter the sum resonance condition. As the amplitudes of their secular movements increase, ions leave the QUISTOR field, and are detected as they leave the field.

Our invention is based on our observations that (1) it is possible to create field configurations which support essentially a single nonlinear resonance condition only, and (2) that sum resonances can be made to have extremely narrow bandwidths (which are extremely sharp).

For a good mass spectrometric resolution between ions of different mass-to-charge ratios, all ions of the same mass-to-charge ratio have to be ejected almost simultaneously. Encountering a sum resonance condition, ions with small secular amplitudes increase their amplitude slower than ions with large amplitudes. To eject ions of the same kind within a very small time interval, it is therefore necessary to force ions of the same kind to have almost equal secular amplitudes.

Our invention therefore, provides an additional method of producing ions in a small volume, located outside the center of a storage field. If ions are produced in such a way, they show very similar secular movement amplitudes. This method requires a good vacuum within the QUISTOR so that the ion secular movements are not damped by collisions with residual gas molecules.

Our invention provides an additional method to enhance the resolution during ion ejection; ions are either generated in the field center, or damped by a gas added to cause the ion secular movements to collapse into the center by repeated collisions. The secular oscillations of the ions to be ejected are then increased selectively by resonance with an additional RF field across the center a short time before they encounter the sum resonance by the scanning RF quadrupole storage field.

If the frequency of the additional RF signal is chosen a little lower than the frequency of the sum resonance condition, and the storage field is scanned towards the higher storage RF voltages, then the ions of a selected mass-to-charge ratio first start to resonate within the additional RF field. They increase thereby their secular movement amplitudes synchronously. In the progress of the scan, and eventually before the ion movements are damped again by the damping gas, the ions encounter the sum resonance condition, and leave the QUISTOR field synchronously.

If the frequency of the additional RF field is tuned into the frequency of the sum resonance condition, a double resonance effect appears. The effect on the resolution is similar, but the exact tuning of the additional RF frequency into the sum resonance frequency makes this method by far more difficult. The present method, furthermore, has the advantage that small shifts of the sum resonance frequency, caused for instance by surface charges on the QUISTOR electrodes, do not disturb the operation.

Figure 2:
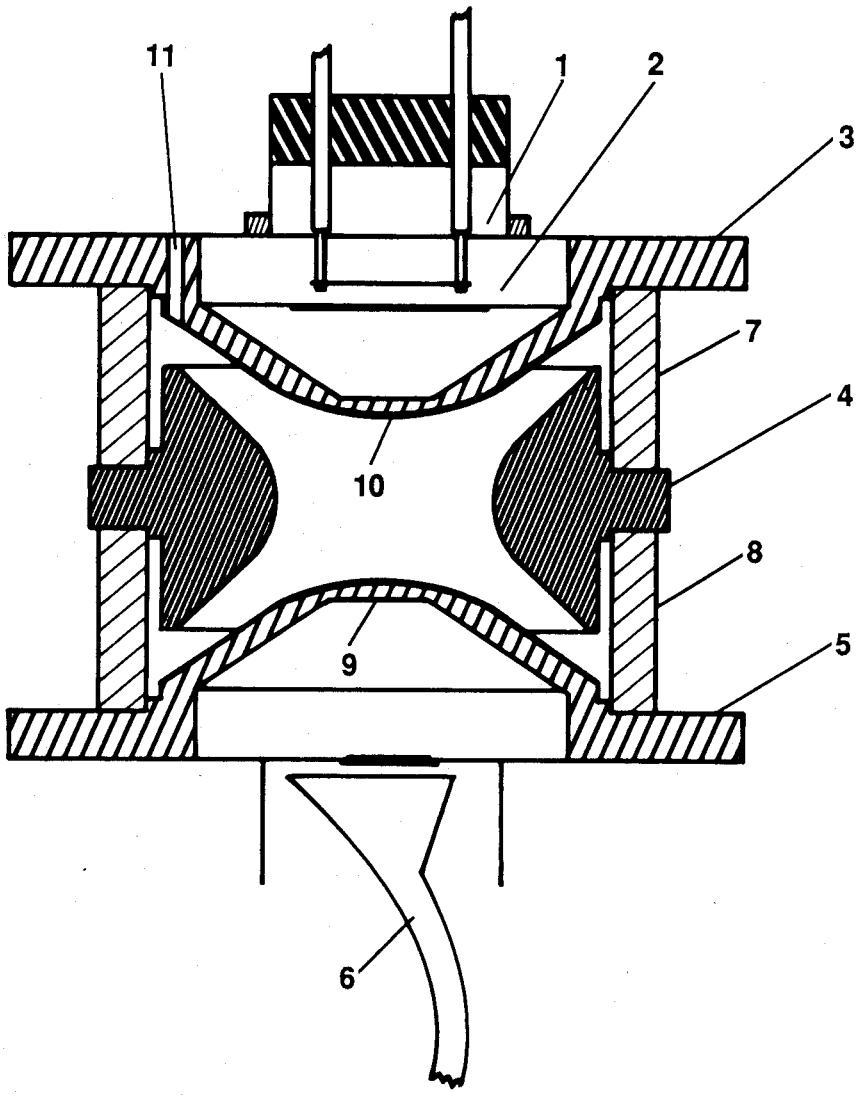
FIG. 2 shows the design of an inharmonic QUISTOR mass spectrometer. The angle of the asymptote measures 1:1.385 (other details are given in the text)

A hitherto best inharmonic QUISTOR mass spectrometer (FIG. 2) can be designed by ring (4) and end electrodes (3), (5), formed precisely hyperbolically with an angle 1:1.385 of the hyperbole asymptotes. The electrodes are spaced by insulators (7) and (8). Ions may be formed by an electron beam which is generated by a heated filament (1) and a lens plate (2) which focuses the electrons through a hole (10) in the end cap (3) into the inharmonic QUISTOR during the ionization phase, and stops the electron beam during other time phases. The movement of the ions inside the inharmonic QUISTOR is damped by the introduction of a damping gas of low molecular weight through entrance tube (11). Among other damping gases, like Helium, normal air at a pressure of $3*10^{-4}$ mbar turns out to be very effective.

The sum resonance frequency $f_{res,z}$ in the z direction, in this case obeys the resonance condition $$f_{res,z}+f_{res,z}=f_{stor}/2,$$

can be measured to be about $$f_{res,z}=0.342*f_{stor}$$

Using a storage frequency of fstor = 1 MHz, the additional frequency across the end electrodes can be chosen as $f_{exc}=333.333$ kHz. The latter can be advantageously generated from the oscillator which produces the frequency of the storage voltage, by a frequency division. The optimum voltage of the exciting frequency depends a little on the scan speed, and ranges from 1 Volt to about 20 Volts.

During the scan period, ions are ejected through the perforations (9) in the end cap (5), and measured by the multiplier (6).

Figure 3:
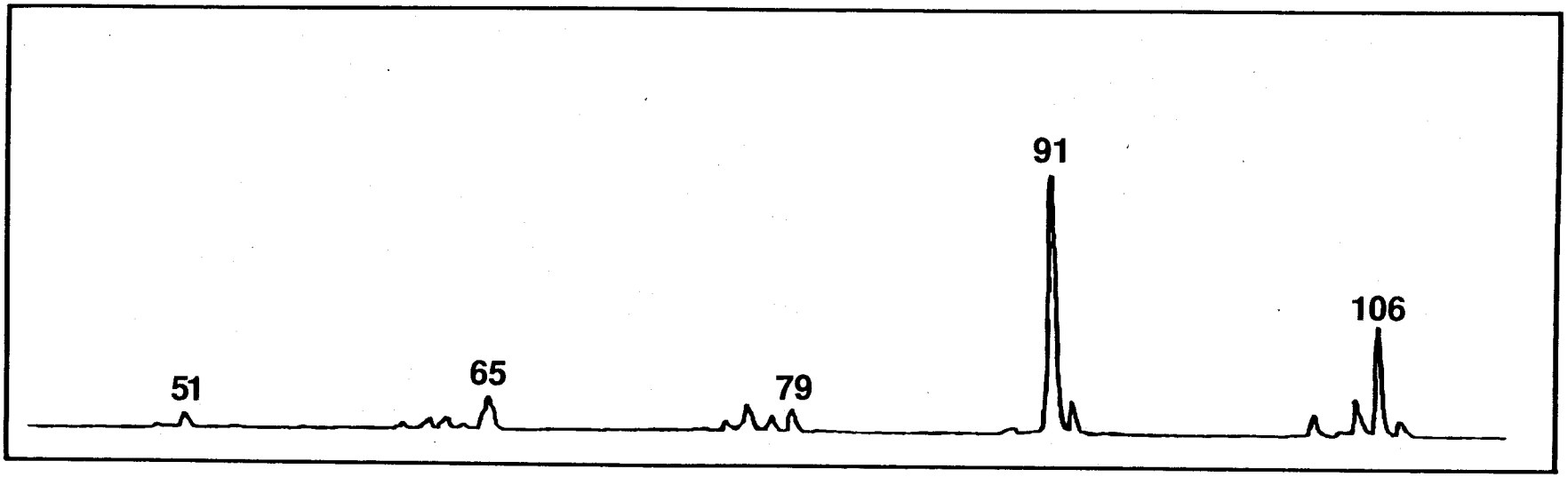
FIG. 3 shows the portion of a mass spectrum measured by a scan of a 1 MHz storage RF voltage amplitude with an inharmonic QUISTOR.

With an inner radius of the ring electrode (4) of $r_o = 1$ cm, and with ions stored in the QUISTOR during a preceding ionization phase, a scan of the high frequency storing voltage Vstor from a storage voltage upwards to 7.5 kV yields a spectrum up to more than 500 atomic mass units in a single scan (FIG. 3). A full scan over 500 atomic mass units can be performed in only 10 milliseconds. This is the fastest scan rate which has been reported for a QUISTOR.

In FIG. 3 there is shown a single scan measurement of trimethyl benzene. The full spectrum covered the mass range from 40 amu to 500 amu, and was measured in 9.2 milliseconds. With 1 millisecond ionization time, and 8 milliseconds of damping in $4*10_{-4}$ mbar air, the total spectrum generation took less than 20 milliseconds. The secular amplitudes of the ions were increased by resonance with a 333.333 kHz additional voltage of 3 Volts only across the end electrodes, prior to an exposition of the ions to the sum resonance condition.

What is claimed is:

1. A method of measuring a mass spectrum of sample material which comprises the steps of defining a three-dimensional electrical inharmonic quadrupole ion storage field in which ions with mass-to-charge ratios in a range of interest can be simultaneously trapped;

introducing or creating sample ions into the quadrupole field whereby ions of interest are simultaneously trapped and perform mass-to-charge specific secular movements;

changing this quadrupole field so that simultaneously and stably trapped ions of consecutive mass-to-charge ratios encounter a nonlinear resonance of their secular movements, will increase thereby their secular movement amplitudes, and then leave the trapping field; and detecting the ions of sequential mass-to-charge ratios as they leave the trapping field.

2. A method of claim 1 in which the inharmonic quadrupole ion storage field is generated by the superposition of an exact quadrupole field with a finite or infinite sum of co-axial multipole fields.

3. Apparatus for measuring a mass spectrum of a sample material in which a storage field is generated by a QUISTOR of the type having a ring electrode and spaced end electrodes whereby the inharmonic quadrupole field is generated by the shape of the electrode surfaces being in the shape of two rotation-symmetric hyperbolic end caps and a rotation-symmetric hyperbolic torrid with an angle of the inscribed asymptotic double-cone deviating from 1:1.414.

4. Apparatus as in claim 3 with a cone angle between 1:1.34 and 1:1.410.

5. Apparatus as in claim 4 characterized in that the ions stored in the field are generated outside the exact center of the field.

6. Apparatus as in claim 5 in which the ions are generated in a distinct location outside the center of the field.

7. Apparatus as in claim 6 in which the ion generation is located in the r-plane in a distance from the field center of about $\frac{1}{8}$ to 1/6 of the inner diameter of the ring electrode.

8. Apparatus as in claim 6 in which the ion generation is located in the field axis in a distance of about $\frac{1}{8}$ to $\frac{1}{4}$ of the distance between the end electrodes.

* * * * *